US009776815B2

(12) United States Patent
Taguchi et al.

(10) Patent No.: US 9,776,815 B2
(45) Date of Patent: Oct. 3, 2017

(54) FEEDING DEVICE AND RECORDING APPARATUS INCLUDING THE FEEDING DEVICE

(71) Applicant: CANON KABUSHIKI KAISHA, Tokyo (JP)

(72) Inventors: Motoyuki Taguchi, Komae (JP); Kenji Soya, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/013,423

(22) Filed: Aug. 29, 2013

(65) Prior Publication Data

US 2014/0062000 A1 Mar. 6, 2014

(30) Foreign Application Priority Data

Aug. 30, 2012 (JP) ..... 2012-189958

(51) Int. Cl.
*B65H 3/52* (2006.01)
*B65H 3/06* (2006.01)
*B65H 3/56* (2006.01)

(52) U.S. Cl.
CPC ..... *B65H 3/06* (2013.01); *B65H 3/0669* (2013.01); *B65H 3/0684* (2013.01); *B65H 3/5223* (2013.01); *B65H 3/56* (2013.01); *B65H 2402/46* (2013.01); *B65H 2404/5311* (2013.01); *B65H 2405/1118* (2013.01); *B65H 2405/1134* (2013.01); *B65H 2405/1136* (2013.01); *B65H 2801/39* (2013.01)

(58) Field of Classification Search
CPC ..... B65H 3/0623; B65H 3/46; B65H 3/54; B65H 3/02; B65H 3/06; B65H 1/04; B65H 1/266; B65H 3/56; B65H 1/12; B65H 3/00; B65H 3/0615; B65H 3/24; B65H 3/0669; B65H 3/0684; B65H 3/0638; B65H 3/5261; B65H 2801/06; B65H 2403/42; B65H 3/5223; B65C 9/10; G06K 13/103
USPC ..... 271/121, 122, 124, 114, 117, 118
See application file for complete search history.

(56) References Cited

U.S. PATENT DOCUMENTS 4,526,358 A * 7/1985 Ura ..... B65H 3/5223 271/122
5,377,970 A * 1/1995 Kikuchi ..... B65H 3/5223 271/117
5,857,671 A * 1/1999 Kato ..... B65H 3/5223 271/10.11
5,895,040 A * 4/1999 Oleksa et al. ..... 271/124
(Continued)

FOREIGN PATENT DOCUMENTS

JP 63-57446 * 3/1988
JP H11-011719 A 1/1999
(Continued)

*Primary Examiner* — Thomas Morrison
(74) *Attorney, Agent, or Firm* — Canon USA, Inc. I.P. Division

(57) ABSTRACT

A feeding device includes a roller configured to feed an uppermost sheet of a plurality of sheets stacked in a stacking unit, and an inclined separator located downstream of the roller in a feed direction and configured to separate one sheet from another sheet. The inclined separator includes a first separator and a second separator that are arranged along the feed direction. Resistance imparted to each sheet by the first separator is greater than resistance imparted to each sheet by the second separator.

5 Claims, 21 Drawing Sheets

(56) References Cited

U.S. PATENT DOCUMENTS

| | | | | |
|---|---|---|---|---|
| 6,565,077 | B2 * | 5/2003 | Kawada | 271/10.03 |
| 6,880,821 | B2 | 4/2005 | Park | |
| 7,097,171 | B2 | 8/2006 | Kang | |
| 7,128,316 | B2 * | 10/2006 | Nakano et al. | 271/121 |
| 7,370,858 | B2 * | 5/2008 | Youn | 271/121 |
| 7,455,288 | B2 * | 11/2008 | Ruhe et al. | 271/124 |
| 7,798,483 | B2 * | 9/2010 | Oomori | 271/118 |
| 7,887,044 | B2 * | 2/2011 | Uchino et al. | 271/121 |
| 2006/0180992 | A1 * | 8/2006 | Asada | B65H 3/0661 271/121 |
| 2009/0026693 | A1 * | 1/2009 | Lim | B65H 1/04 271/121 |
| 2011/0127713 | A1 * | 6/2011 | Emoto | B65H 3/0684 271/147 |
| 2011/0156339 | A1 * | 6/2011 | Nakano | 271/4.11 |
| 2011/0221123 | A1 * | 9/2011 | Otani | B65H 1/266 271/171 |

FOREIGN PATENT DOCUMENTS

| | | | |
|---|---|---|---|
| JP | 2004-067389 | A | 3/2004 |
| JP | 2008-150167 | A | 7/2008 |

* cited by examiner

FEEDING DEVICE AND RECORDING APPARATUS INCLUDING THE FEEDING DEVICE

BACKGROUND OF THE INVENTION

Field of the Invention

The present invention relates to a feeding device configured to convey a sheet of paper (recording medium) one by one and to a recording apparatus that includes the feeding device and is configured to form an image on the sheet.

Description of the Related Art

U.S. Pat. No. 6,880,821 discusses a recording apparatus that includes a feeding device configured to convey a plurality of sheets set in a feed cassette one by one from the feed cassette. This feeding device in the recording apparatus includes a swing arm feed mechanism unit, having a feed roller provided at a leading end thereof, and an inclined separator. The swing arm feed mechanism unit is configured to transmit rotary drive force from a feed roller rotary drive unit (not illustrated) to the feed roller, and the feed roller at the leading end is in contact with the surface of an uppermost one of the sheets set in the feed cassette. Upon receiving the rotary drive force, the feed roller rotates in a direction to convey the sheet toward the inclined separator. The inclined separator includes, on a front surface thereof, a plurality of fixed separation portions and a plurality of movable separation portions, and the movable separation portions are configured to be movable between a contact position and a non-contact position with the sheet by a cam disposed on a rear surface of the inclined separator. This cam is connected to a rotary lever, and rotating this rotary lever allows the positions of the movable separation portions to change.

When the feeding device conveys a sheet having low stiffness, the movable separation portions are moved to the contact position to increase a contact area between the sheet and the inclined separator. Thus, frictional force between the sheet and the inclined separator increases, and the frictional force between the sheet and the inclined separator exceeds frictional force between the sheet and another sheet, which suppresses a double feed of the sheets. In contrast, when the feeding device conveys a sheet having high stiffness, the movable separation portions are moved to the non-contact position to allow the sheet to make contact only with the fixed separation portions, and thus a contact area between the sheet and the inclined separator is decreased. Then, the frictional force between the sheet and the inclined separator decreases, and the sheet is smoothly conveyed along the inclined separator, which suppresses a non-feed of the sheet.

U.S. Pat. No. 7,097,171 discusses a recording apparatus that includes a feeding device configured to convey a plurality of sheets set in a feed cassette one by one from the feed cassette using a belt. This feeding device in the recording apparatus includes a swing arm feed mechanism unit, having a feed roller provided at a leading end thereof, and an inclined separator, on which the belt is provided. The swing arm feed mechanism unit is configured to transmit rotary drive force from a feed roller rotary drive unit (not illustrated) to the feed roller, and the feed roller at the leading end is in contact with the surface of an uppermost one of the sheets set in the feed cassette. Upon receiving the rotary drive force, the feed roller rotates in a direction to convey the sheet toward the inclined separator. The inclined separator includes a plurality of separation portions and the belt for imparting frictional force to the leading end of the sheet.

If the frictional force between the uppermost sheet and the second sheet from the top in the feed cassette is large, when the uppermost sheet is conveyed, the second sheet is likely to be conveyed as well along with the uppermost sheet. However, as the belt makes contact with the second sheet, a double feed of the second sheet is suppressed. The belt rotates in a direction to impart, to the sheet, conveyance force that acts in a direction opposite to that of the feed roller. Thus, even if the uppermost sheet and a sheet immediately underneath the uppermost sheet (the second sheet) are conveyed from the feed cassette to the inclined separator, the frictional force between the belt and the second sheet prevents the second sheet from being conveyed beyond the inclined separator and sends the second sheet back to the feed cassette.

However, as the number of sheets set in the feed cassette decreases, a load of the sheets on the feed cassette decreases as well, and in turn frictional force between the sheets and the feed cassette decreases, which may allow a double feed of sheets to occur more easily. Therefore, it is necessary to impart appropriate frictional force to the sheets to suppress a double feed.

In the recording apparatus discussed in U.S. Pat. No. 6,880,821, the movable separation portions are moved to the contact position to increase the frictional force between the inclined separator and the sheet. However, this increases the frictional force across the entire inclined separator, and thus if only a single sheet is conveyed to the inclined separator, the sheet may not smoothly slide on the inclined separator. Thus, the sheet may slack, and the conveyance of the sheet may in turn be suspended on the surface of the inclined separator, which may result in a non-feed of the sheet.

Similarly, in the recording apparatus discussed in U.S. Pat. No. 7,097,171, the belt is provided over the entire center area of the inclined separator along the conveyance direction of the sheet. Thus, when only a single sheet is conveyed to the inclined separator, the sheet may not smoothly slide on the inclined separator. In addition, the leading end of the sheet may be caught by the belt, and thus the sheet may be damaged and may not be conveyed correctly along the surface of the inclined separator. As a result, the conveyance of the sheet may be suspended, which may result in a non-feed of the sheet.

SUMMARY OF THE INVENTION

The present invention is directed to a feeding device capable of suppressing a double feed or a non-feed even when the number of sheets set in a feed cassette is low and to a recording apparatus including such a feeding device.

According to an aspect of the present invention, a feeing device includes a roller configured to feed an uppermost sheet of a plurality of sheets stacked in a stacking unit, and an inclined separator located downstream of the roller in a feed direction and configured to separate one sheet from another sheet. The inclined separator includes a first separator and a second separator that are arranged along the feed direction, wherein resistance imparted to each sheet by the first separator is greater than resistance imparted to each sheet by the second separator.

According to an exemplary embodiment of the present invention, a double feed or a non-feed can be suppressed even when the number of sheets set in a feed cassette is low.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

Figure 1:
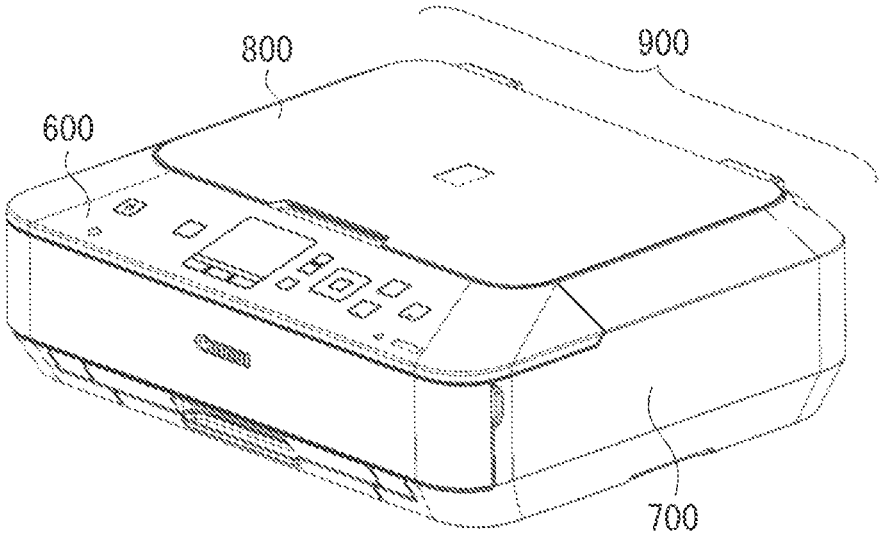
FIG. 1 is a perspective view illustrating a recording apparatus according to a first exemplary embodiment of the present invention.

FIG. 1 is a perspective view illustrating a recording apparatus according to a first exemplary embodiment of the present invention.

Figure 2:
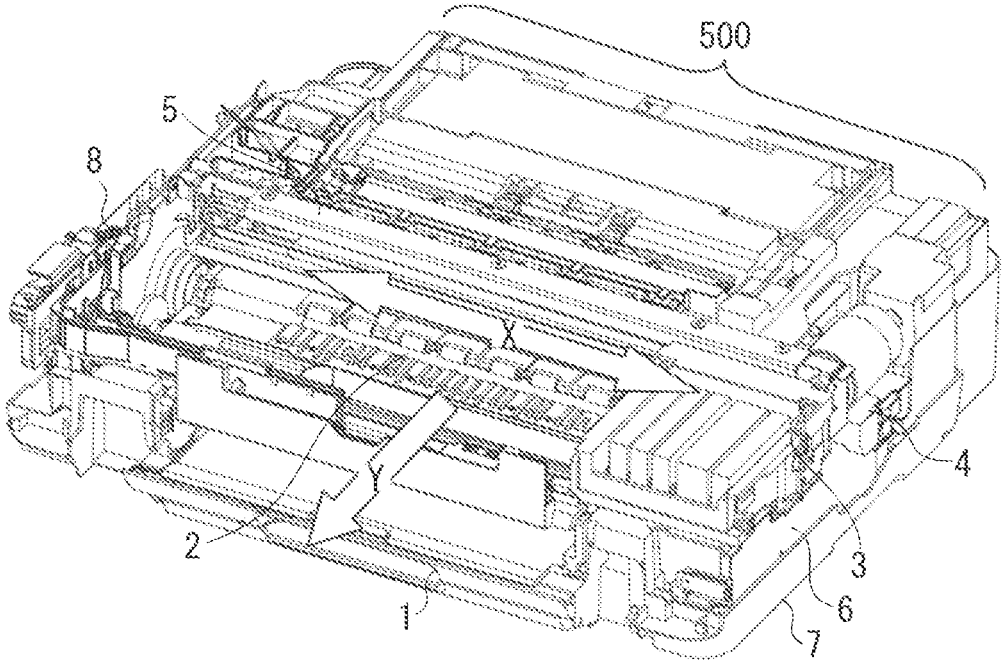
FIG. 2 is a perspective view illustrating an engine unit included in the recording apparatus according to the first exemplary embodiment.

A recording apparatus 900 includes a panel unit 600, an exterior unit 700, and a scanner unit 800. Operation buttons for inputting operation instructions to the recording apparatus 900 are arranged on the panel unit 600, and the scanner unit 800 scans to capture an image. As illustrated in FIG. 2, in which the exterior unit 700 is removed, an engine unit 500 is disposed inside the recording apparatus 900.

The engine unit 500 includes a feed unit 1, a conveyance unit, a recording unit, a drive switch unit 4, a chassis unit 5, a recovery device unit 6, a bottom unit 7, and an electric substrate 8. The conveyance unit conveys a sheet 100, which has been conveyed by the feed unit 1, to the recording unit, where an image is to be formed, with a conveyance roller 2, and also conveys a sheet 100 on which an image has been formed to a discharge unit (not illustrated). The recording unit includes a carriage 3, on which an ink tank and a recording head (not illustrated) for discharging ink are mounted. The carriage 3 is configured to reciprocate immediately above a recording surface of the sheet 100 in directions orthogonal to a conveyance direction of the sheet 100 in the recording unit, where an image is formed.

Figure 3:
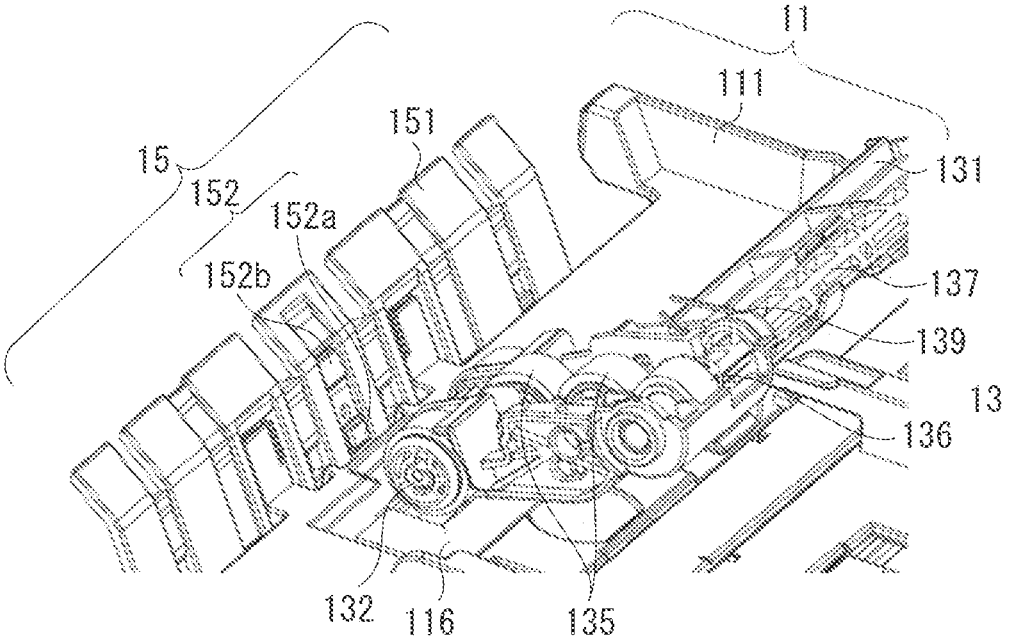
FIG. 3 is a perspective view illustrating a feed unit according to the first exemplary embodiment.
Figure 4:
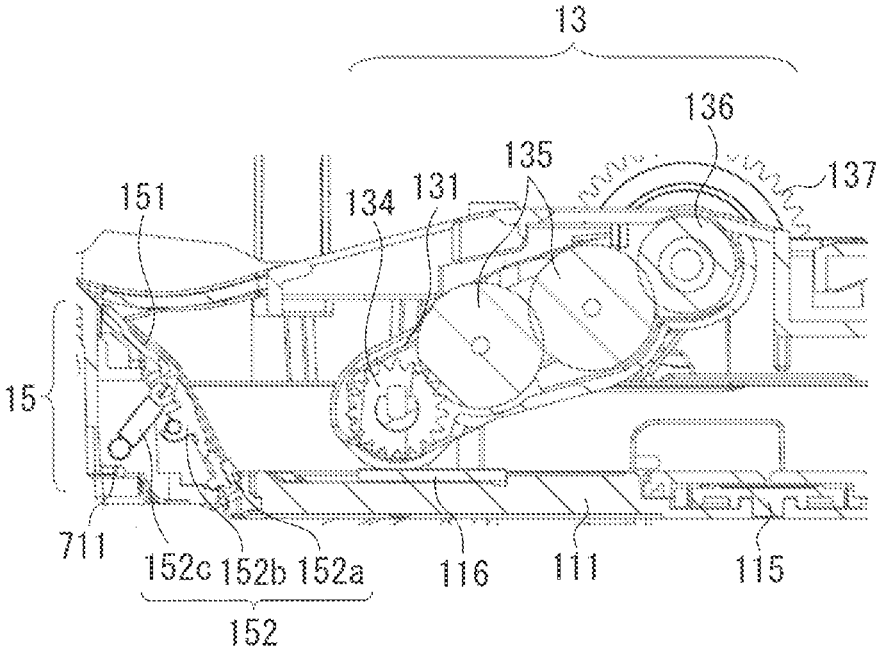
FIG. 4 is a sectional view illustrating the feed unit according to the first exemplary embodiment.

As illustrated in FIGS. 3 and 4, the feed unit 1 includes a feed cassette unit 11, on which sheets 100 are to be stacked, a swing arm feed mechanism unit 13, and an inclined separator 15.

Figure 5:
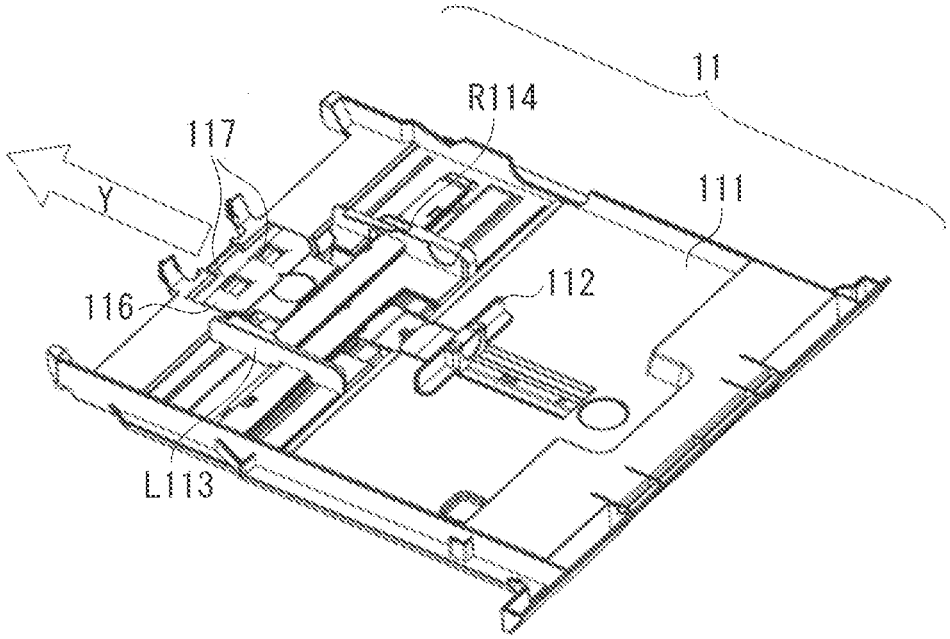
FIG. 5 is a perspective view illustrating a feed cassette unit according to the first exemplary embodiment.

The sheets 100 are to be set in the feed cassette unit 11, and the feed cassette unit 11 is housed in the recording apparatus 900 with the feed cassette unit 11 being inserted into a bottom frame unit (not illustrated). As illustrated in FIG. 5, the feed cassette unit 11 includes a feed cassette 111 serving as a stacking unit. The multiple sheets 100 can be stacked in the feed cassette 111, and the feed cassette 111 includes an end guide 112 and side guides L113 and R114. The end guide 112 sets the position of and supports a trailing end of the sheet 100, and the side guides L113 and R114 set the positions of and support width-wise ends of the sheet 100. The end guide 112 and the side guides L113 and R114 are configured to be movable in the feed cassette 111 in accordance with the size of the sheet 100.

Figure 6:
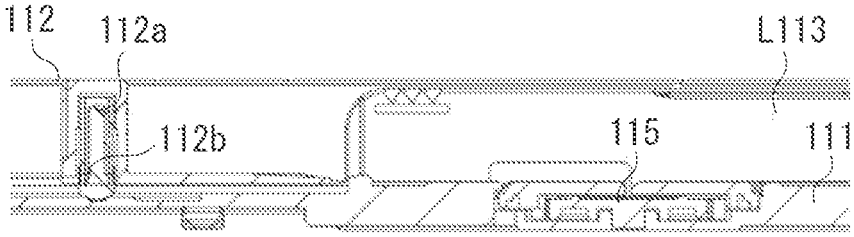
FIG. 6 is a sectional view illustrating an end portion of the feed cassette unit according to the first exemplary embodiment.

The end guide 112 is movable by sliding on a groove in the feed cassette 111. As illustrated in FIG. 6, a lock pin 112*b* is provided inside the end guide 112 to press the feed cassette 111 with an end guide spring 112*a*. This configuration gives a user a click feeling when the user operates the end guide 112 and also allows the end guide 112 to support the trailing end of the sheet 100.

Figure 7:
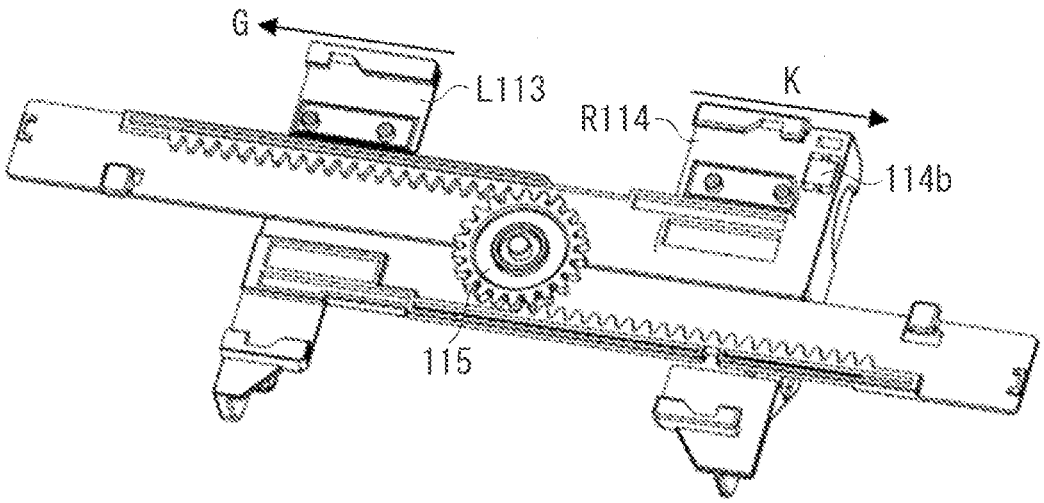
FIG. 7 is a perspective view illustrating side guides in the feed cassette unit according to the first exemplary embodiment.
Figure 8:
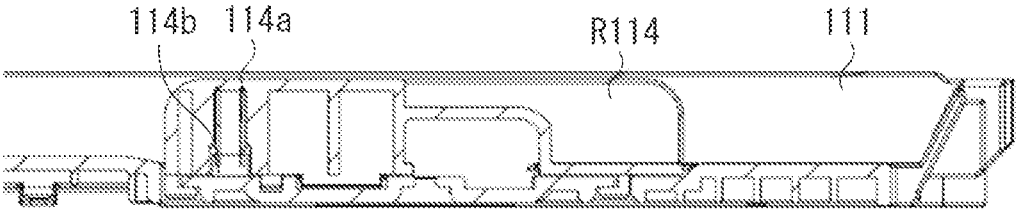
FIG. 8 is a sectional view illustrating the side guide in the feed cassette unit according to the first exemplary embodiment.

As illustrated in FIG. 7, the side guides L113 and R114 each include a planar support surface for supporting the sheet 100, and a rack is provided on a rear surface of the support surface. A side guide gear 115 is provided at a center portion of the feed cassette 111, and the racks of the side guides L113 and R114 mesh with the side guide gear 115 with the side guide gear 115 sandwiched between the racks. With this configuration, rotation of the side guide gear 115 causes the side guides L113 and R114 to move respectively in opposite directions along the width-wise direction of the sheet 100. As illustrated in FIG. 8, a side guide spring 114*a* and a side guide friction pad 114*b* are provided inside the side guide R114, and the side guide spring 114*a* presses the side guide friction pad 114*b* against the feed cassette 111. Frictional force between the side guide friction pad 114*b* and the feed cassette 111 allows the side guides L113 and R114 to set the position of the sheet 100.

Referring back to FIGS. 3 and 5, the feed cassette 111 includes a cassette friction pad 116 with a large friction coefficient provided at a location where a feed roller 132 of the swing arm feed mechanism unit 13 abuts against the feed cassette 111, to suppress a double feed of a lowermost one of the stacked sheets 100. In addition, a cassette roller 117 is provided within the same location as the cassette friction pad 116 to cause the feed roller 132 to idle while the sheet 100 is not placed in the feed cassette 111, so that the feed roller 132 does not bite into the feed cassette 111.

Figure 9:
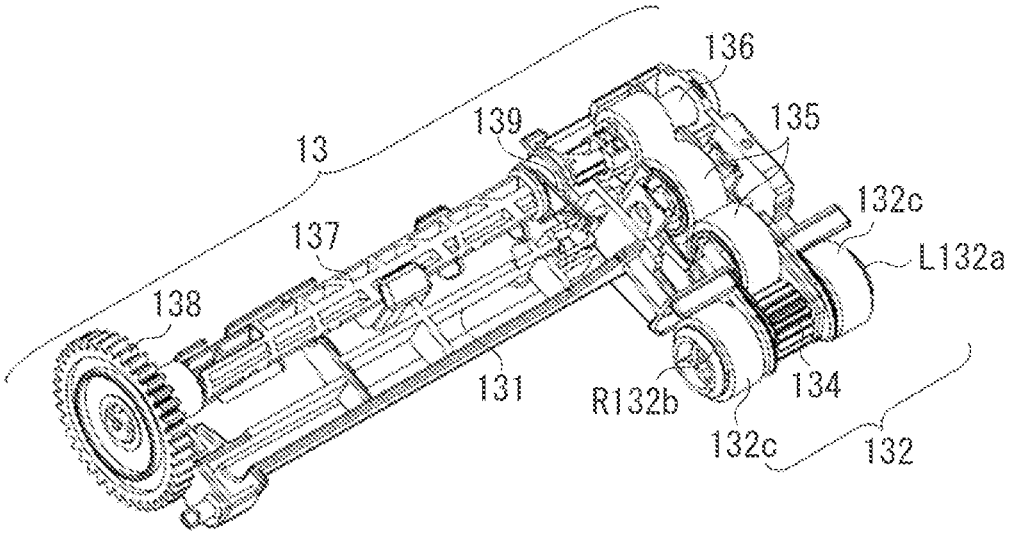
FIG. 9 is a perspective view illustrating a swing arm feed mechanism unit according to the first exemplary embodiment.

As illustrated in FIG. 9, the swing arm feed mechanism unit 13 includes a swing arm 131, a feed gear 134, idler gears 135, a delay gear 136, a feed shaft 137, a feed input gear 138, and a swing arm pressure spring 139. The feed roller 132 is supported at a leading end of the swing arm 131, and feed rubber pieces 132*c* are mounted respectively to right and left rollers (i.e., feed rollers L132*a* and R132*b*) of the feed roller 132. The feed rollers L132*a* and R132*b* are connected to each other by a single shaft passing through the respective centers of the feed rollers L132*a* and R132*b* with a bearing unit of the swing arm 131 and the feed gear 134 sandwiched therebetween. Rotary drive force is transmitted to the feed gear 134 through the feed input gear 138, the feed shaft 137, the delay gear 136, and the two idler gears 135, and the rotation of the feed gear 134 causes the feed roller 132 to rotate. Further, the swing arm pressure spring 139 biases the swing arm 131 with spring force generated between the swing arm pressure spring 139 and a bottom frame (not illustrated) in a direction in which the feed roller 132 is pressed against the sheet 100.

Figure 10:
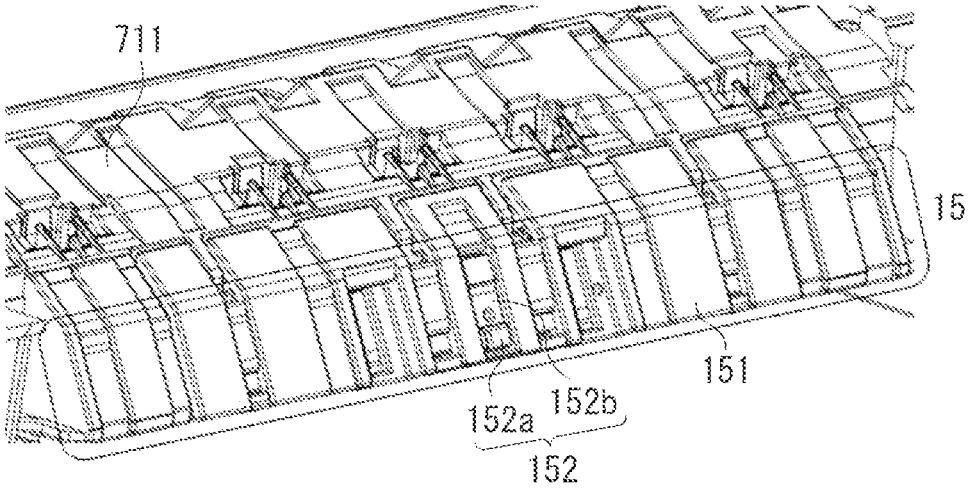
FIG. 10 is a perspective view illustrating an inclined separator according to the first exemplary embodiment.
Figure 11:
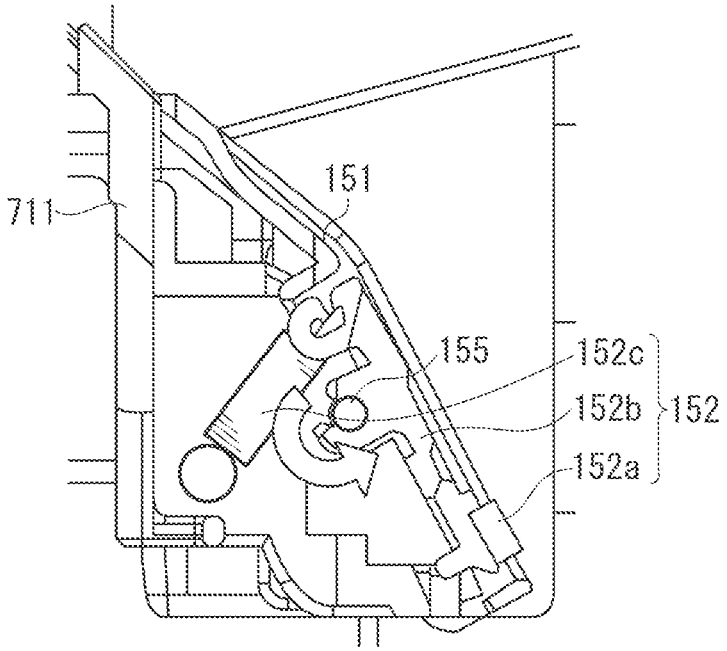
FIG. 11 is a side view illustrating the inclined separator according to the first exemplary embodiment.
Figure 12:
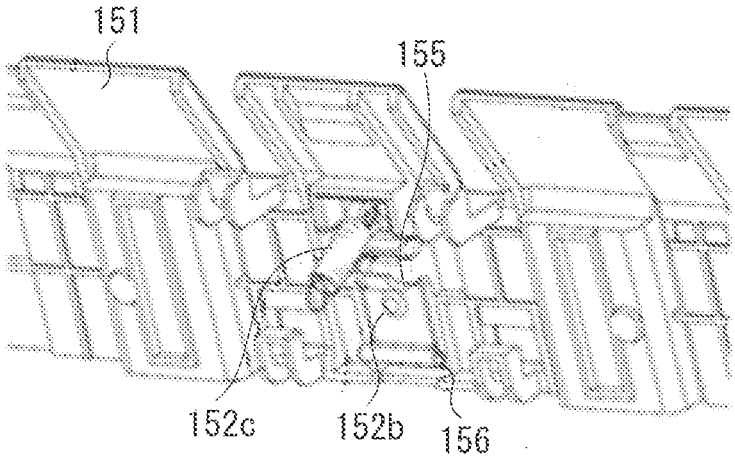
FIG. 12 is a rear view illustrating the inclined separator according to the first exemplary embodiment.

As illustrated in FIG. 10, the inclined separator 15 is disposed to be inclined relative to a direction in which the sheet 100 is fed by the feed roller 132. The inclined separator 15 includes an inclined member 151, connected to a bottom frame 711, and an inclined friction portion 152. The inclined separator 15 makes contact with a stack of sheets 100 fed by the feed roller 132 to separate an uppermost sheet 100 from the rest. As illustrated in FIG. 11, the inclined friction portion 152 is rotatably mounted to the inclined member 151 with a shaft 155. The inclined friction portion 152 includes an inclined friction pad holder 152*b*, to which an inclined friction pad 152*a* is stuck. The inclined friction pad 152*a* is formed of a material having a large friction coefficient. As illustrated in FIG. 12, an inclined friction portion spring 152*c* connected to the bottom frame 711 is connected to the inclined friction pad holder 152*b*. Elasticity of the inclined friction portion spring 152*c* biases the inclined friction pad holder 152*b* in a direction in which the inclined friction pad holder 152*b* rotates in a counterclockwise direction about the shaft 155. The inclined friction pad holder 152*b* is urged against a rear surface of the inclined member 151 by the elasticity of the inclined friction portion spring 152*c* and is positioned by a boss 156. While the inclined friction pad holder 152*b* is urged against the rear surface of the inclined member 151, the inclined friction pad 152*a* on the inclined friction pad holder 152*b* projects from a surface of the inclined member 151.

Figure 13:
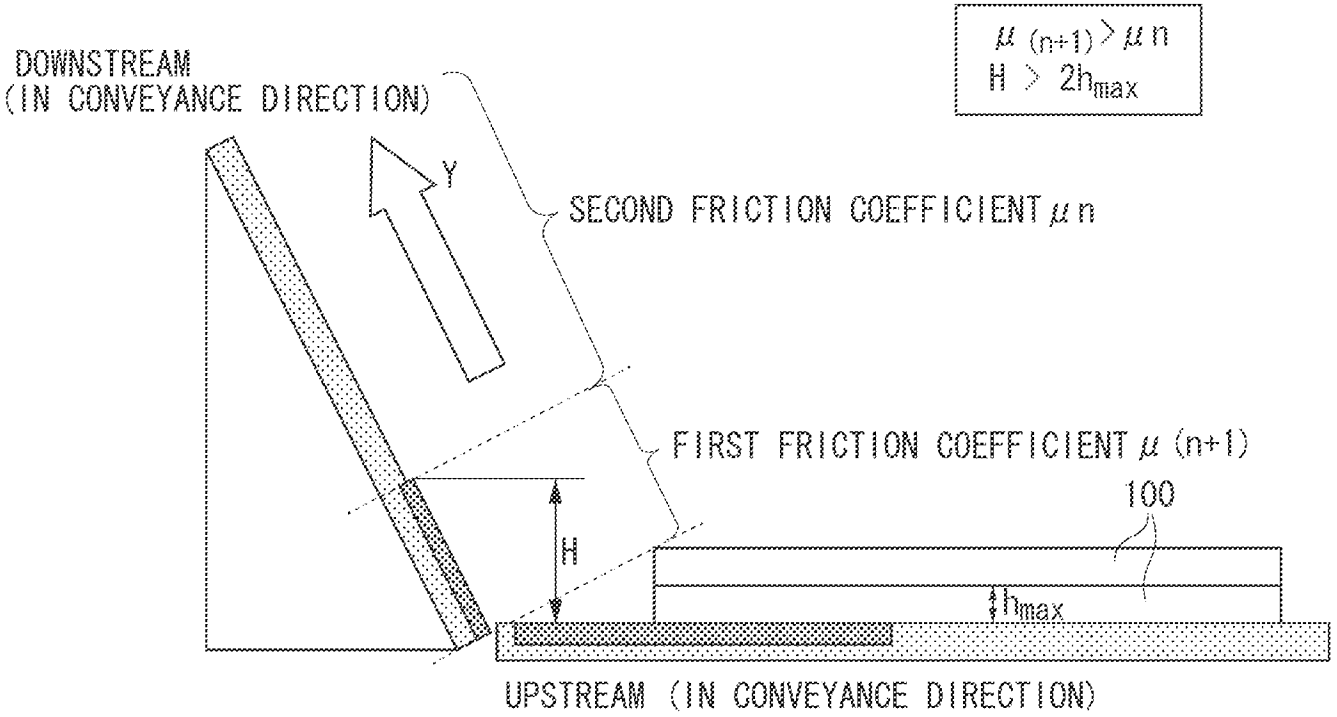
FIG. 13 is a sectional view illustrating a positional relationship between a first separator and a second separator in the inclined separator according to the first exemplary embodiment.
Figure 14:
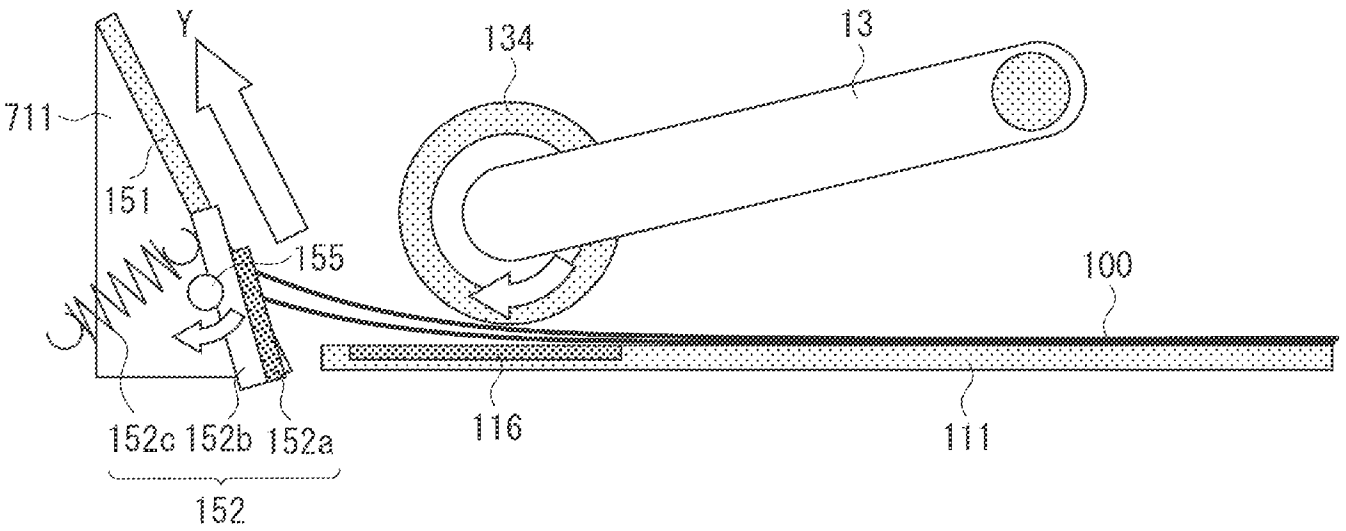
FIG. 14 is a side view illustrating the inclined separator according to the first exemplary embodiment.
Figure 15:
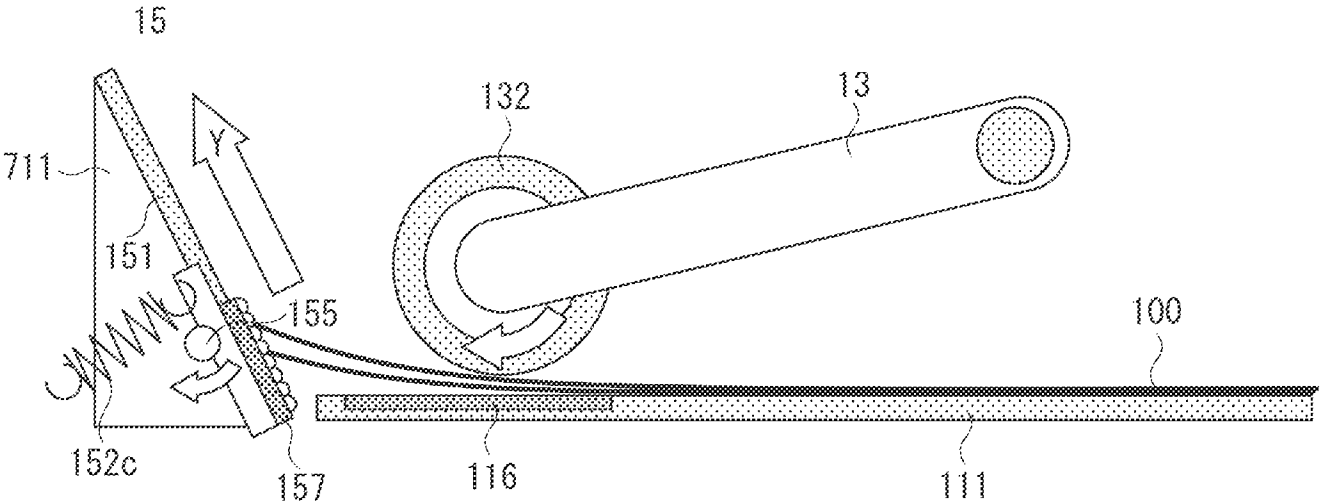
FIG. 15 is a side view illustrating a modification of the inclined separator according to the first exemplary embodiment.

As illustrated in FIGS. 13 and 14, in the inclined separator 15, the inclined friction portion 152 serving as a first separator is provided upstream in a conveyance direction of the sheet 100, and the inclined member 151 serving as a second separator is provided downstream in the conveyance direction. The surface of the inclined friction portion 152 has a first friction coefficient $\mu_{(n+1)}$, and the surface of the inclined member 151 has a second friction coefficient $\mu_n$. The first friction coefficient $\mu_{(n+1)}$ is greater than the second friction coefficient $\mu_n$. Since the surface of the inclined friction portion 152 has the first friction coefficient $\mu_{(n+1)}$, as an alternative, as illustrated in FIG. 15, a member 157 having a rough surface may be used in place of the inclined friction portion 152. In that case, the inclined member 151 may be formed by a member having lower surface roughness than that of the inclined friction portion 152 or by an inclined friction pad 152*a* having a smaller friction coefficient than that of the member 157 having the aforementioned rough surface.

As viewed in a direction perpendicular to the feed cassette 111, a height H of a boundary portion between the inclined member 151 and the inclined friction portion 152 (see FIG. 13) is greater than the height of two sheets 100 each having a thickness $h_{max}$ stacked in the feed cassette 111. That is, a relationship of the height H of the boundary portion being greater than $2h_{max}$ is satisfied.

A method for feeding a sheet with the feeding device having the configuration described above will now be described.

A user removes the feed cassette unit 11 from the recording apparatus 900 to stack the sheets 100 that are suited for forming an image. The user then moves the end guide 112 and the side guides L113 and R114 provided on the feed cassette 111 to release positions in accordance with the size of the sheets 100 and stacks the sheets 100 in the feed cassette 111. After stacking the sheets 100 and moving the end guide 112 and the side guides L113 and R114 to positions for supporting the sheets 100, the user places the feed cassette unit 11 into the recording apparatus 900.

Upon the feed cassette unit 11 being set in the feed unit 1 of the recording apparatus 900, the feed roller 132 provided at the leading end of the swing arm 131 of the swing arm feed mechanism unit 13 makes contact with the surface of an uppermost one of the sheets 100 stacked in the feed cassette 111. As the surface of the feed roller 132 makes contact with the surface of the uppermost sheet 100, preparation for conveying the sheets 100 is complete. Upon image data being input to the recording apparatus 900, feeding processes for conveying the sheets 100 from the feed cassette 111 to the recording unit start.

To convey the sheets 100 in the feed cassette 111 to the recording unit, a feed roller rotary drive unit (not illustrated) provides rotary drive force to the feed input gear 138, and the rotary drive of the feed input gear 138 is transmitted to the feed shaft 137, the delay gear 136, and the idler gears 135 to cause the feed roller 132 to rotate. Clockwise rotation of the feed roller 132 causes the uppermost sheet 100, which is in contact with the feed roller 132, to move toward the inclined separator 15. As the leading end of the uppermost sheet 100 fed by the feed roller 132 abuts against the inclined separator 15, frictional force is generated between the leading end of the sheet 100 and the inclined separator 15. However, conveyance force of the feed roller 132 is greater than the generated frictional force. Therefore, the leading end of the sheet 100 is slidably conveyed along an inclined surface of the inclined separator 15, and thus the entire sheet 100 is slidably conveyed through the inclined separator 15 with the conveyance force of the feed roller 132. A conveyance roller (not illustrated) is provided downstream of the inclined separator 15 in the conveyance direction of the sheet 100, and this conveyance roller conveys the sheet 100 to the recording unit.

With reference to FIGS. 16A to 16D, a method for feeding a sheet 100 in a state where two sheets 100 remain in the feed cassette 111 will be described.

Figure 16A:
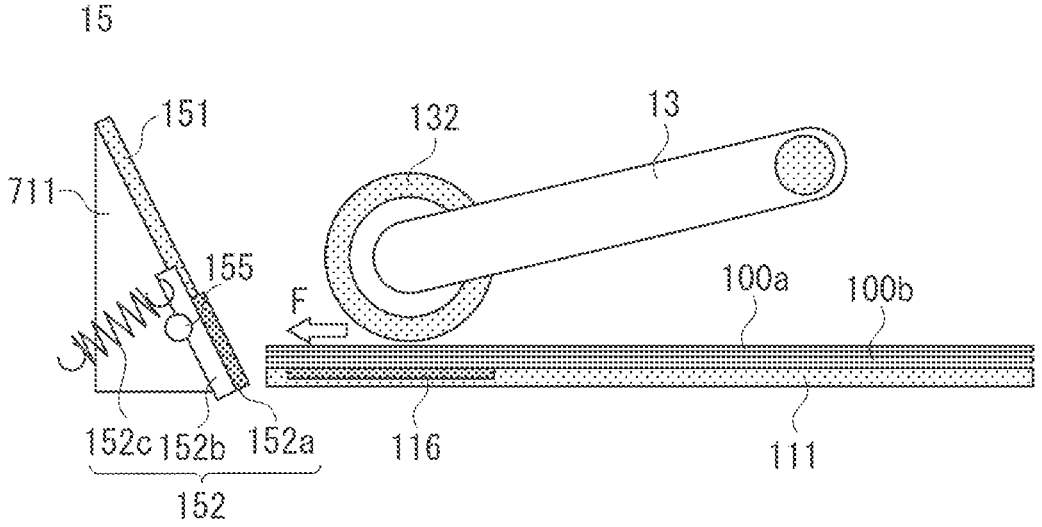
FIGS. 16A, 16B, 16C, and 16D are side views collectively illustrating processes of separating one sheet from the other and conveying the one sheet by the feeding device according to the first exemplary embodiment.
Figure 16B:
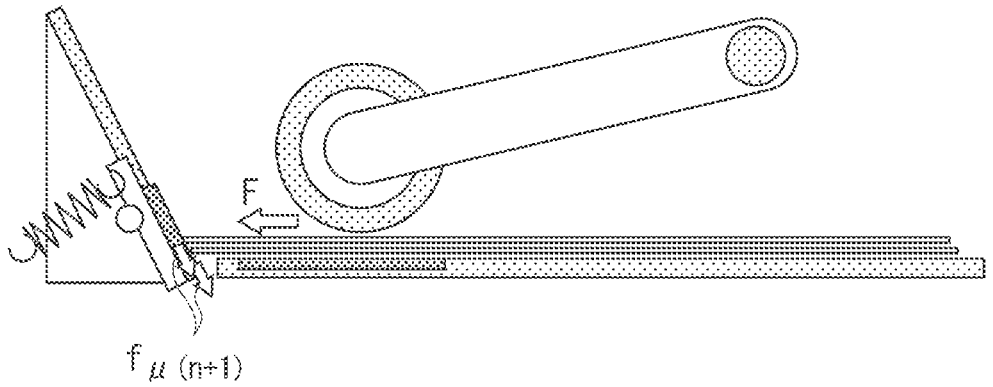

As illustrated in FIG. 16A, in a state where two sheets 100 (i.e., an upper sheet 100*a* and a lower sheet 100*b*) are stacked in the feed cassette 111, the feed roller 132 rotates to provide conveyance force F to the upper sheet 100*a*. Then, as illustrated in FIG. 16B, the leading end of the upper sheet 100*a* abuts against the inclined friction pad 152*a* of the inclined friction portion 152 provided in the inclined separator 15 due to the conveyance force F. At this point, frictional force or electrostatic force present between the upper sheet 100*a* and the lower sheet 100*b* produces force that causes the lower sheet 100*b* to move toward the inclined separator 15, and thus the leading end of the lower sheet 100*b* also abuts against the inclined friction pad 152*a*. As the leading ends of the upper sheet 100*a* and the lower sheet 100*b* abut against the inclined friction pad 152*a*, which has the first friction coefficient $\mu_{(n+1)}$, frictional force $f_{\mu(n+1)}$ is generated between the inclined friction pad 152*a* and each of the leading ends of the upper sheet 100*a* and the lower sheet 100*b*. In this case, as illustrated in FIG. 14, the inclined friction portion 152 swings in a clockwise direction around the shaft 155. A portion of the inclined friction pad 152*a* that is pressed by the sheets 100 withdraws to the position of the inclined surface of the inclined separator 15. A portion of the inclined friction pad 152*a* that is upstream (i.e., lower side) in the conveyance direction of the position where the sheets 100 abut against the inclined friction pad 152*a* withdraws further from the inclined surface of the inclined separator 15.

Figure 16C:
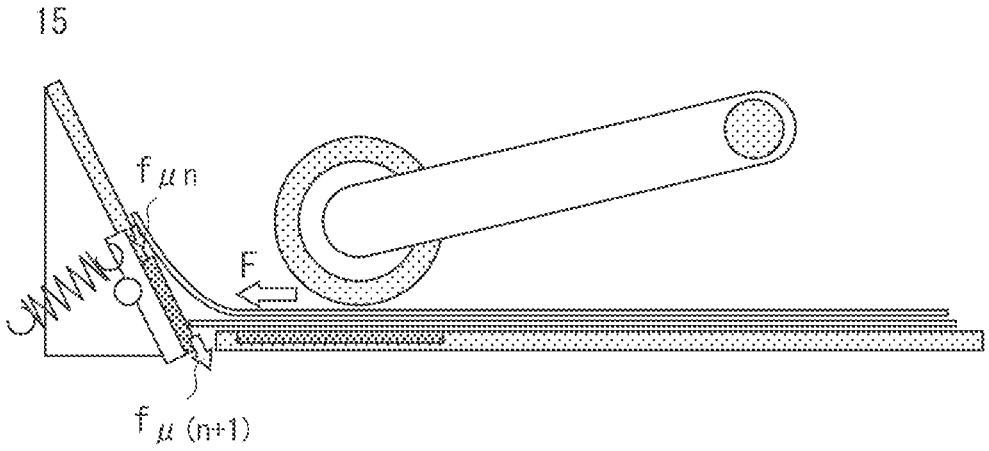

Since the upper sheet 100*a* is subjected to the conveyance force F that is greater than the frictional force $f_{\mu(n+1)}$ by the feed roller 132, as illustrated in FIG. 16C, the leading end of the upper sheet 100*a* crosses over the inclined friction pad 152*a* and moves to the inclined member 151. On the other hand, since the conveyance force F is not transmitted to the lower sheet 100*b*, the leading end of the lower sheet 100*b* does not cross over the inclined friction pad 152*a*, and thus the leading end of the lower sheet 100*b* remains at a position where the leading end abuts against the inclined friction pad 152*a*. Thus, the upper sheet 100*a* is separated from the lower sheet 100*b*, and only the upper sheet 100*a* is conveyed downstream of the inclined separator 15 in the conveyance direction. Accordingly, a double feed of the upper sheet 100*a* and the lower sheet 100*b* can be prevented. In this way, the inclined friction portion 152 provides resistance to the moving sheets 100 to separate the upper sheet 100*a* from the lower sheet 100*b*. This separating resistance represents the ease of separation between the upper sheet 100*a* and the lower sheet 100*b* and is determined mainly by the friction coefficient of the inclined separator 15. In the first exemplary embodiment, first separating resistance of the inclined friction portion 152 serving as the first separator is greater than second separating resistance of the inclined member 151 serving as the second separator. Accordingly, the upper sheet 100*a* is separated from the lower sheet 100*b*.

Further, as the inclined friction pad 152*a* rotates, the angle of the inclined friction pad 152*a* relative to the feed direction of the sheet 100*a* approaches a right angle. Therefore, resistance against the lower sheet 100*b* increases, and thus separation performance improves. The magnitude of reaction force which the sheet 100*a* receives from the inclined friction pad 152*a* as the sheet 100*a* abuts against the inclined friction pad 152*a* is limited within a range of biasing force of the inclined friction portion spring 152*c*, and thus excessively large reaction force does not act on the leading end of the sheet 100*a*.

If the friction coefficient of the cassette friction pad 116 serving as a friction member provided in the feed cassette 111 is large, large frictional force is generated between the lower sheet 100*b* and the cassette friction pad 116. This frictional force acts in a direction opposite to the direction in which the lower sheet 100*b* moves toward the inclined separator 15, and if this frictional force is large, the lower sheet 100*b* is less likely to move from the feed cassette 111, which in turn suppresses a double feed. Accordingly, the cassette friction pad 116 having a large friction coefficient may be used to further suppress a double feed.

Figure 16D:
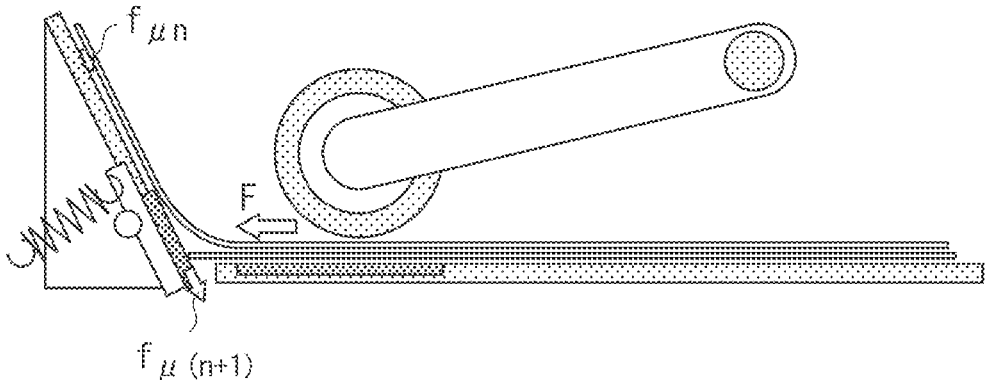

As illustrated in FIG. 16D, the leading end of the upper sheet 100*a* that has crossed over the inclined friction pad 152*a* makes contact with the inclined member 151, and thus frictional force is generated between the upper sheet 100*a* and the inclined member 151 having the second friction coefficient $\mu_n$. The frictional force $f_{\mu n}$ is smaller than the friction force $f_{\mu(n+1)}$, and thus the upper sheet 100*a* slidably moves along the surface of the inclined member 151 of the inclined separator 15. Therefore, even if the upper sheet 100*a* has low stiffness, the upper sheet 100*a* does not slack prior to reaching the conveyance roller (not illustrated), and thus a non-feed of the upper sheet 100*a* can be suppressed.

Figure 17:
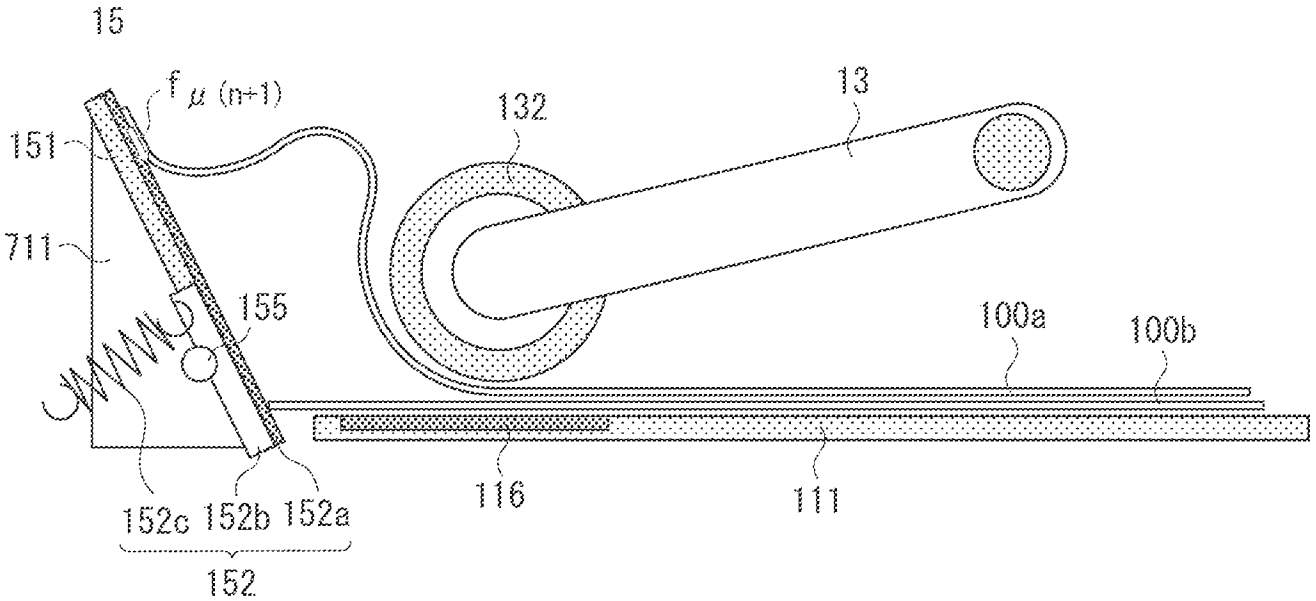
FIG. 17 is a side view illustrating a state where a sheet has slacked in a conventional inclined separator.

In a configuration employing a conventional technique, the entire surface of the inclined separator 15 along the conveyance direction of the sheet 100 has a large friction coefficient, which results in a problem in that the leading end of the upper sheet 100*a* stops moving partway on the inclined separator 15. As illustrated in FIG. 17, when large frictional force $f_{\mu(n+1)}$ is generated at the leading end of the upper sheet 100*a*, if the sheet 100*a* has low stiffness, the sheet 100*a* slacks at a location between the leading end and a portion that is in contact with the feed roller 132. Thus, a non-feed occurs, that is, the sheet 100*a* is not conveyed.

In the first exemplary embodiment, since the inclined separator 15 is configured to have a smaller friction coefficient at a downstream side thereof in the conveyance direction of the sheet 100, even a sheet 100 having low stiffness can slidably move along the surface of the inclined separator 15 with the conveyance force F of the feed roller 132, and thus a non-feed of the sheet 100 can be suppressed.

As described thus far, in the first exemplary embodiment, the inclined friction portion having a large friction coefficient is provided on the inclined separator at an upstream side thereof in the conveyance direction of the sheet. Thus, large frictional force is generated between the lower sheet and the inclined separator, and the upper sheet is separated from the lower sheet, which suppresses a double feed. In addition, the inclined member having a small friction coefficient is provided in the inclined separator at a downstream side thereof in the conveyance direction of the sheet. Thus, the sheet can slidably move across the inclined separator, which suppresses a non-feed.

Figure 18A:
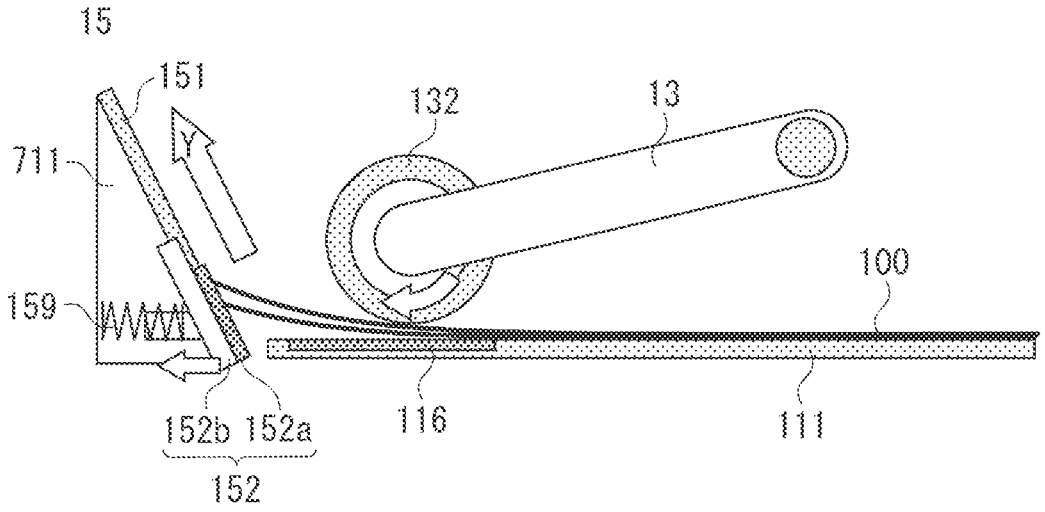
FIGS. 18A and 18B are side views each illustrating an inclined separator according to a second exemplary embodiment of the present invention.
Figure 18B:
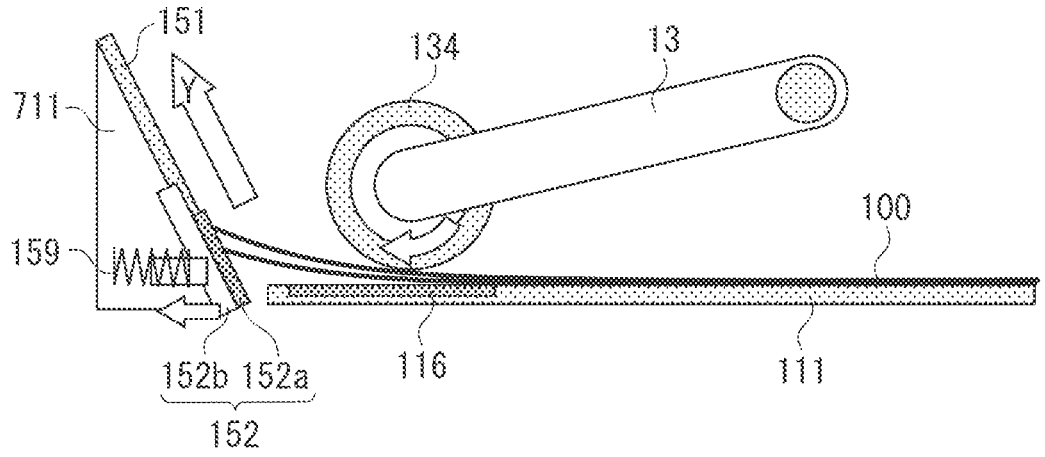

FIGS. 18A and 18B are side views each illustrating a feeding device including an inclined separator according to a second exemplary embodiment of the present invention.

Figure 19:
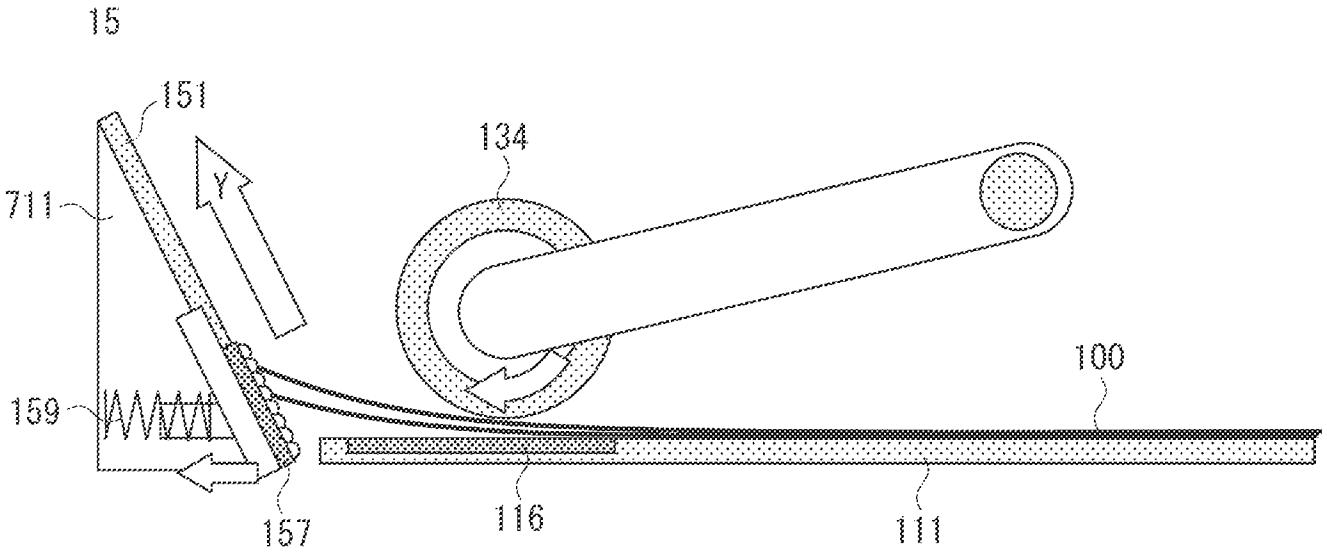
FIG. 19 is a side view illustrating a modification of the inclined separator according to the second exemplary embodiment.

The inclined friction portion 152 is attached to the bottom frame 711 with a linear spring 159, and elasticity of the linear spring 159 can translate the inclined friction portion 152 in the horizontal direction as viewed from a side surface of the inclined separator 15. The inclined friction portion 152 includes the inclined friction pad holder 152*b*, to which the inclined friction pad 152*a* is stuck. The inclined friction pad 152*a* is formed of a material having a large friction coefficient. While the inclined friction pad holder 152*b* is urged against the rear surface of the inclined member 151, the inclined friction pad 152*a* on the inclined friction pad holder 152*b* projects from the front surface of the inclined member 151. Alternatively, as illustrated in FIG. 19, a member 157 having a rough surface may be used in place of the inclined friction portion 152. In that case, the inclined member 151 may be formed by a member having lower surface roughness than that of the inclined friction portion 152 or by an inclined friction pad 152*a* having a smaller friction coefficient than that of the member 157 having the aforementioned rough surface. Other configurations are similar to those of the first exemplary embodiment, and thus the description thereof will be omitted.

When the leading ends of the upper sheet 100*a* and the lower sheet 100*b* make contact with the inclined friction pad 152*a*, the inclined friction portion 152 moves in the horizontal direction as viewed from a side surface of the inclined separator 15. Then, the entire surface of the inclined friction pad 152*a* withdraws to the position of the inclined surface of the inclined separator 15. Other processes in the feeding method are similar to those of the first exemplary embodiment, and thus the description thereof will be omitted.

As described thus far, in the second exemplary embodiment, the inclined friction portion having a large friction coefficient is provided on the inclined separator at an upstream side thereof in the conveyance direction of the sheet. Thus, large frictional force is generated between the lower sheet and the inclined separator, and the upper sheet is separated from the lower sheet, which suppresses a double feed. In addition, the second exemplary embodiment allows the number of components constituting the inclined friction portion to be reduced, and thus the overall cost of manufacturing the feeding device can be reduced.

Figure 20:
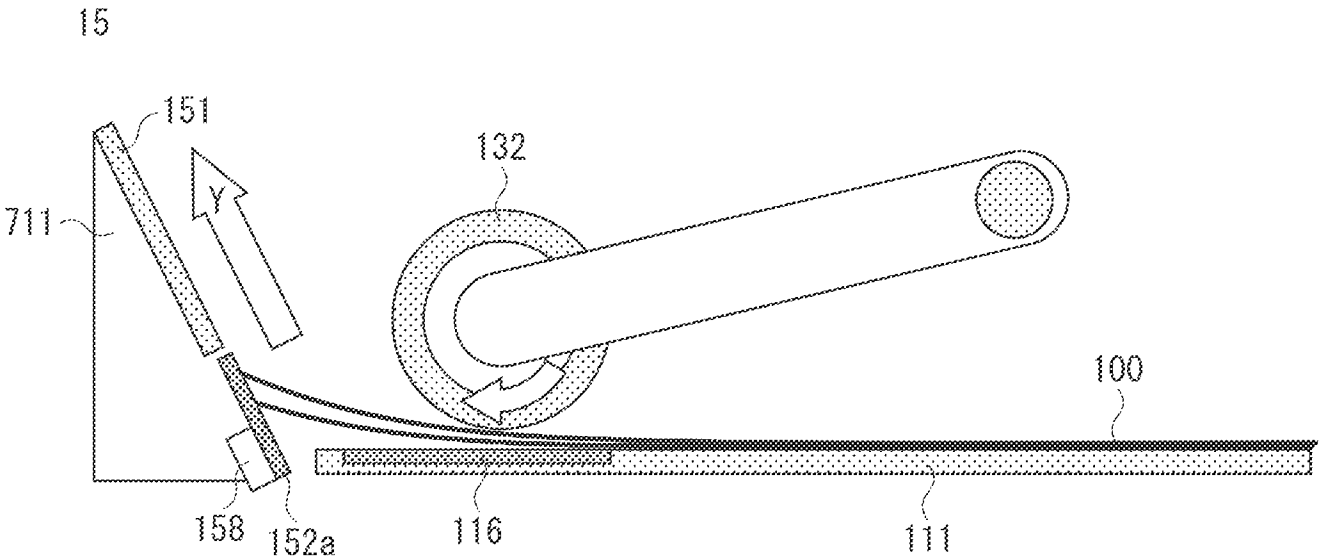
FIG. 20 is a side view illustrating an inclined separator according to a third exemplary embodiment of the present invention.

FIG. 20 is a side view illustrating a feeding device including an inclined separator according to a third exemplary embodiment of the present invention.

The inclined separator 15 includes the inclined member 151, the inclined friction pad 152*a*, and an elastic member 158 formed of elastomer such as rubber. The inclined member 151 is provided downstream of the inclined friction pad 152*a* in the conveyance direction. The upstream end of the inclined friction pad 152*a* in the conveyance direction is fixed to the bottom frame 711 with the elastic member 158. The downstream end of the inclined friction pad 152*a* in the conveyance direction is not fixed, and thus the inclined friction pad 152*a* can swing about the upstream end thereof as the elastic member 158 deforms. While the elastic member 158 is not deformed, the surface of the inclined friction pad 152*a* projects from the front surface of the inclined member 151.

The downstream end of the inclined friction pad 152*a* is not connected to the bottom frame 711. Thus, when the leading ends of the upper sheet 100*a* and the lower sheet 100*b* abut against the inclined friction pad 152*a*, the downstream end of the inclined friction pad 152*a* withdraws and is bent with the end connected to the bottom frame 711 serving as the fulcrum. Other processes in the feeding method are similar to those of the first exemplary embodiment, and thus the description thereof will be omitted.

The inclined friction pad 152*a* and the elastic member 158 may be integrally-molded with elastomer.

As described thus far, in the third exemplary embodiment of the present invention, the inclined friction portion having a large friction coefficient is provided on the inclined separator at an upstream side in the conveyance direction of the sheet. Thus, large frictional force acts on the lower sheet, which suppresses a double feed. In addition, the third exemplary embodiment allows the number of components constituting the inclined friction portion to be reduced and does not employ a component for connecting with the bottom frame, and thus the overall cost of manufacturing the feeding device can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-189958 filed Aug. 30, 2012, which is hereby incorporated by reference herein in its entirety.

What is claimed is:

1. A sheet supplying apparatus comprising:

a stacking surface on which a plurality of sheets are to be stacked;

a feed roller configured to feed an uppermost sheet of the plurality of sheets stacked on the stacking surface in a feed direction;

an inclined separator having a friction part located downstream of the feed roller and a stationary separator disposed adjacent to the inclined separator, configured to separate the uppermost sheet fed by the feed roller from the others, wherein the inclined separator rotates relative to the stationary separator about a rotational shaft that is mounted on the stationary separator and has a center axis that extends in parallel to the stacking surface and is perpendicular to the feed direction, and the inclined separator comprises an upper part that is higher than the rotational center axis and a lower part that is lower than the rotational center axis on which the friction part is provided; and a pull spring disposed behind the inclined separator, configured to pull the upper part of the inclined separator such that the lower part of the inclined separator is urged toward the feed roller, wherein the inclined separator rotates against a pull force of the pull spring such that an inclined angle of the friction part changes relative to the stacking surface, when a leading end of each sheet fed by the feed roller presses the friction part.

2. The sheet supplying apparatus according to claim 1, wherein the stationary separator has a stationary inclined surface that is stationary for guiding the sheet fed by the feed roller.

3. The sheet supplying apparatus according to claim 1, wherein the plurality of sheets are provided in a sheet cassette that is detachably attached to an apparatus body, and the feed roller, the inclined separator, and the pull spring are arranged in the apparatus body.

4. The sheet supplying apparatus according to claim 3, wherein the sheet cassette includes a friction member provided on the stacking surface below the feed roller for increasing frictional force of a lowermost sheet of the plurality of sheets stacked on the stacking surface.

5. A recording apparatus comprising:

a recording unit configured to form an image on a sheet; and a sheet supplying apparatus comprising:

a stacking surface on which a plurality of sheets are to be stacked;

a feed roller configured to feed an uppermost sheet of the plurality of sheets stacked on the stacking surface in a feed direction;

an inclined separator having a friction part located downstream of the feed roller and a stationary separator disposed adjacent to the inclined separator, configured to separate the uppermost sheet fed by the feed roller from the others, wherein the inclined separator rotates relative to the stationary separator about a rotational shaft that is mounted on the stationary separator and has a center axis that extends in parallel to the stacking surface and is perpendicular to the feed direction, and the inclined separator comprises an upper part that is higher than the rotational center axis and a lower part that is lower than the rotational center axis on which the friction part is provided; and a pull spring disposed behind the inclined separator, configured to pull the upper part of the inclined separator such that the lower part of the inclined separator is urged toward the feed roller, wherein the inclined separator rotates against a pull force of the pull spring such that an inclined angle of the friction part changes relative to the stacking surface, when a leading end of each sheet fed by the feed roller presses the friction part, and wherein the plurality of sheets are provided in a sheet cassette that is detachably attached to an apparatus body, and the feed roller, the inclined separator and the pull spring are arranged in the apparatus body.

* * * * *